US011841017B2

(12) United States Patent
Harking

(10) Patent No.: US 11,841,017 B2
(45) Date of Patent: Dec. 12, 2023

(54) ECCENTRIC-SCREW PUMP WITH CONCENTRICITY SENSOR

(71) Applicant: SEEPEX GMBH, Bottrop (DE)

(72) Inventor: Julian Harking, Bottrop (DE)

(73) Assignee: SEEPEX GMBH, Bottrop (DE)

( * ) Notice: Subject to any disclaimer, the term of this patent is extended or adjusted under 35 U.S.C. 154(b) by 0 days.

(21) Appl. No.: 17/619,877

(22) PCT Filed: Oct. 28, 2020

(86) PCT No.: PCT/EP2020/080251
§ 371 (c)(1),
(2) Date: Dec. 16, 2021

(87) PCT Pub. No.: WO2021/094087
PCT Pub. Date: May 20, 2021

(65) Prior Publication Data

US 2022/0356877 A1 Nov. 10, 2022

(30) Foreign Application Priority Data

Nov. 15, 2019 (DE) ..... 102019130981.6

(51) Int. Cl.
*F03C 2/00* (2006.01)
*F03C 4/00* (2006.01)
(Continued)

(52) U.S. Cl.
CPC ..... *F04C 2/107* (2013.01); *F04C 2/1071* (2013.01); *F04C 14/28* (2013.01); *F04C 2270/86* (2013.01)

(58) Field of Classification Search
CPC ..... F04C 2/107; F04C 2/1071; F04C 2/1073; F04C 2/1075; F04C 14/28; F04C 2270/806; F04C 2270/86; F01C 1/101
See application file for complete search history.

(56) References Cited

U.S. PATENT DOCUMENTS 5,679,894 A 10/1997 Kruger
6,358,027 B1 * 3/2002 Lane ..... F04C 2/1071 418/48
(Continued)

FOREIGN PATENT DOCUMENTS

CN 106812694 A 6/2017
DE 202005005989 U 9/2005
(Continued)

OTHER PUBLICATIONS

DE-102018102640A1—Overmeier et al.—Cavity Pump—Aug. 8, 2019—the English Machine Translation (Year: 2019).*

*Primary Examiner* — Theresa Trieu
(74) *Attorney, Agent, or Firm* — Andrew Wilford

(57) ABSTRACT

An eccentric screw pump has a stator, a rotor rotating in the stator, a drive, and a pump housing connected to the stator and having at least one inlet or outlet opening for a medium to be conveyed. A connecting shaft driven by the drive rotates concentrically with an axis, and a connecting housing connected between the pump housing and the drive at least partially surrounds the connecting shaft. A coupling-side shaft seal lies between the connecting shaft and the connecting housing, and a coupling rod in the pump housing is connected to the connecting shaft at a drive-side end and to the rotor at a rotor-side end thereof and generating eccentric movement of the rotor-side end on concentric rotation of the connecting shaft. A sensor is mounted in or on the connecting housing adjacent the connecting shaft for detecting or measuring deviation from axially concentric rotation thereof.

11 Claims, 2 Drawing Sheets

(51) Int. Cl.

| | |
|---|---|
| ***F04C 2/00*** | (2006.01) |
| ***F04C 18/00*** | (2006.01) |
| ***F04C 2/107*** | (2006.01) |
| ***F04C 14/28*** | (2006.01) |

(56) References Cited

U.S. PATENT DOCUMENTS

| | | | | |
|---|---|---|---|---|
| 8,268,172 | B2 | 9/2012 | Yoshida | |
| 8,439,659 | B2 | 5/2013 | Loeker | |
| 10,161,397 | B2 | 12/2018 | Dicks | |
| 2011/0103934 | A1* | 5/2011 | Ohtachi | F04D 19/042 415/118 |
| 2015/0010604 | A1 | 1/2015 | Ishii et al. | |

FOREIGN PATENT DOCUMENTS

| | | | | |
|---|---|---|---|---|
| DE | 102005019063 | A | 11/2006 | |
| DE | 102010034440 | A1 * | 2/2011 | C02F 9/005 |
| DE | 102018102640 | A | 8/2019 | |
| DE | 102018102640 | A1 * | 8/2019 | F04C 2/1071 |
| DE | 102020111386 | A1 * | 10/2021 | F04C 2/1071 |
| GB | 2556425 | A * | 5/2018 | F04C 2/1071 |
| WO | WO-2009024279 | A1 * | 2/2009 | F04C 2/1075 |

* cited by examiner

ECCENTRIC-SCREW PUMP WITH CONCENTRICITY SENSOR

CROSS REFERENCE TO RELATED APPLICATIONS

This application is the US-national stage of PCT application PCT/EP2020/080251 filed 28 Oct. 2020 and claiming the priority of German patent application 102019130981.6 itself filed 15 Nov. 2019.

FIELD OF THE INVENTION

The invention relates to an eccentric screw pump having at least

- a stator,
- a rotor rotating in the stator,
- a pump housing connected (e.g. suction side) to the stator (e.g. suction side) and having at least one inlet or outlet opening for a medium to be conveyed,
- a connecting shaft driven by the drive and rotating concentrically with an axis on ideal operation of the pump,
- a coupling rod (preferably in the pump housing) and connected to the connecting shaft at a drive end and to the rotor at a rotor end thereof and generating eccentric movement of a rotor end on concentric rotation of the connecting shaft.

Such an eccentric screw pump is used to move a wide variety of media and, in particular, highly viscous liquids in various industrial areas. The liquids to be conveyed can also for example contain solid components.

The stator is preferably made of elastic or elastomeric material and is generally surrounded by a stator casing or housing. The pump housing connected on the suction side to the stator is as a rule the housing that is connected to the stator on the pressure side, is referred to as a suction housing and the housing that is connected on the pressure side to the stator, for example as a pressure connection piece. In principle, however, it is also possible to operate the pump in the opposite conveying direction, so that the suction housing (as a pump housing) would then be on the pressure side. In the context of the invention, the designation of the pump housing as a suction housing consequently takes place independently of the actual conveying direction. The housing is between the stator and the drive. The rotating connection that ensures the eccentricity, between the drive or the centrally rotating connecting shaft and the eccentrically rotating rotor is effected via a coupling rod that is for example in the pump housing and is connected to the connecting shaft via a drive-side universal joint and to the rotor via a rotor-side universal joint. Alternatively, the eccentricity can also be realized by other measures, i.e. without joints, for example by means of a flexible or elastically deformable coupling rod. Consequently, the coupling rod is an element that ensures or generates with an articulated configuration or coupling the eccentric movement between the axially concentrically rotating connecting shaft and the rotor or the eccentrically rotating rotor end. The coupling rod can also carry one or more conveying vanes or conveying elements can be fastened to the coupling rod, for example as a worm or screw conveyor. This is realized for example in eccentric screw pumps that are funnel pumps. The screw can be a tubular or solid screw. The connecting shaft is also referred to as a plug-in shaft. As a rule, it is connected integrally or indirectly to the output shaft of the drive and serves as the connecting piece between the output shaft of the drive and the power transmission parts of the pump. The connecting housing between the pump housing (suction housing) and the drive serves for example to receive and support the pump housing on the one hand and the drive on the other hand, so that this connection housing is fastened for example to a base plate or directly to a foundation and supports and supports the drive of the pump housing. Hanging arrangements can also be realized. In practice, a distinction is made between embodiments of the connecting housing as "cradle" on the one hand and "support block" on the other hand. The connecting housing can always be an open or at least an open connecting housing that is consequently accessible from the outside through an opening. Sealing of the pump housing or suction housing with respect to the environment or the connecting housing is effected for example by a shaft seal, in that the connecting shaft is sealed with the shaft seal and in this way the suction housing separates the suction housing from the surroundings in a liquid-tight manner. The shaft seal can be designed for example as a sliding ring seal.

Eccentric screw pumps of this type are known for example from DE 10 201 4 112 552 [U.S. Pat. No. 10,161,397), DE 10 2010 034 440 [U.S. Pat. No. 8,268,172], WO 2009/024279 [U.S. Pat. No. 8,439,659], and DE 10 2018 102 640.

In practice, the eccentric screw pumps or their parts are subject to wear during operation, so that maintenance work or maintenance measures are required at regular intervals. Typical wear parts are the elastic stator, but also the rotor in the elastic stator. Likewise, wear occurs on bearings (e.g. in the drive or transmission) and joints. It is therefore known to monitor the wear of these parts during operation by determining suitable parameters. For example, for monitoring the stator state, it is possible to register the flow rate or the delivery quantity and to compare these values to the respective rotational speeds of the rotor. In a similar manner, the counterpressure of the pump can also be determined by comparison with the rotational speed. In the methods known in this respect, the wear state is thus indirectly determined.

Alternatively, an eccentric screw pump is known from DE 20 2005 008 989 where a measuring sensor is associated with the stator to detect compressions and/or movements of the stator or elastic material in the course of the rotation of the rotor. The measuring sensor can be for example a pressure sensor or a force transducer that is integrated into the stator and registers compressions of the stator. In the foreground, wear of the stator is also monitored here.

In order to detect possible wear on bearings and joints of pumps, vibration measurements are used in practice. This applies for example to centrifugal pumps in which vibration measurements are used to detect bearing damage.

A method of operating an eccentric screw pump for monitoring different operating states is also known from DE 10 2005 019 063, where preliminary tests for certain negative operating states are carried out on the eccentric screw pump, the resulting specific damage frequency image of which is stored and compared during the operating phase with a total vibration image that is removed at only one point of the eccentric screw pump. The sensor is seated for example on the stator inlet.

Finally, DE 10 2015 112 248 (US 2015/00106040) describes an eccentric screw pump having an adjusting mechanism for the stator-rotor system. By means of at least one sensor, actual operating parameters of the stator rotor system are determined and control of the adjustment mechanism taking into account the determined operating parameters. In this case, the wear state should be determined either directly via a corresponding sensor system in the elastomer material of the stator or indirectly via reaction forces of the elastomer on other parts. The sensor can measure for example the pump pressure, the rotational speed, the temperature and/or the volume flow.

OBJECT OF THE INVENTION

Proceeding from the previously known prior art, the object of the invention is to develop a known eccentric screw pump in such a way that damage and in particular joint and/or bearing damage to the pump can be detected in a simple and reliable manner.

SUMMARY OF THE INVENTION

To attain this object, the invention teaches in a generic eccentric screw pump of the type described at the beginning that at least one sensor is mounted adjacent the connecting shaft for detecting or measuring deviation from axially concentric rotation thereof for determining a movement profile at a predetermined angular position of the connecting shaft by measuring a distance between an outer surface of the connecting shaft and the sensor.

According to the invention, damage to the bearings (for example in the drive or the transmission thereof) and/or joints within the pump is not determined or monitored by a conventional vibration measurement, but directly by a determination of the concentricity deviation on the connecting shaft or (largely) centrally running part. The invention is based on the discovery that the wear on bearings, guides and/or joints increases the concentricity deviation of the part of the connecting shaft that rotates axially concentrically in the ideal case. Measurement or monitoring of the concentricity or the concentricity deviation of the connecting shaft can consequently be determined quickly, simply and very reliably for wear on bearings, guides and/or joints of the pump.

Such a sensor is preferably a sensor that operates without contact, for example as a proximity sensor. It can preferably be an inductive proximity sensor. Alternatively, optical sensors, e.g. optical proximity sensors, can also be used. There is always the possibility of determining with such a sensor a possible concentricity deviation of the connecting shaft rotating centrally with ideal concentricity in the ideal case, in that the distance between the surface of the connecting shaft that has a circular cross-section, is preferably measured by the sensor. In ideal operation, the distance of the shaft surface from the sensor does not change during rotation, so that the measured concentricity deviation is recorded over time-zero. If concentricity deviations occur due to damage or wear on bearings, guides and/or joints (enlarged), the sensor does not measure a spacing that is constant over time and consequently over the angle of rotation, but the distance varies over time, and the time corresponds to the respective angular position of the connecting shaft at this point in time.

Particularly preferably, at least two sensors are provided adjacent the connecting shaft in respective different angular positions with respect to the connecting shaft and consequently with an angular offset, such that a (separate) movement profile, i.e. the function of the distance over the time and thus from the angle of rotation of the connecting shaft, is measured with each of these sensors. A particularly reliable detection of concentricity deviations takes place by combining two such measurements. This is because, in the case of certain phenomena, the possibility exists that a single sensor does not reliably detected that a round-trip deviation with a single sensor. The use of two sensors (or possibly also more than two sensors) improves the detection of concentricity deviations. It is within the scope of the invention that the angular offset is at least 10° and/or max 180°. The angular offset is preferably at least 30° and/or max 150°. In practice, an angular offset of approximately 90° is expedient.

In the case of an eccentric screw pump, the fact that a axial concentric movement of the drive is converted by the so-called coupling rod into an eccentric movement of the rotor or rotor end is of particular importance. The measurement of the concentricity deviation takes place adjacent the drive train that rotates centrally, specifically preferably on the last cylindrical part of the rotating shaft (viewed from the drive side) that (still) rotates axial concentrically. In the context of the invention, this centrally rotating cylindrical part or part having a circular diameter is referred to as a connecting shaft. This connecting shaft is connected at its end opposite the drive to the coupling rod and consequently the part that no longer rotates centrally.

Of particular importance is the fact that, in the case of eccentric screws, further disturbance variables due to the direct contact between the rotor and the stator are added to the disturbance variables produced by wear of bearings, guides and/or joints. However, the measurement according to the invention directly relates to the concentricity, so that other disturbance variables do not interfere with the detection.

The sensor or the sensors are preferably arranged between the drive-side end of the connecting shaft and a coupling-side shaft seal, for example a sliding ring seal, in relation to the axial extension of the pump. As a rule, the eccentric screw pump has an (additional or separate) connecting housing between the pump housing or suction housing and the drive, and the connecting shaft is surrounds at least in regions by this connecting housing. Such a connection housing can be a cradle or as a support block. The sensor or the sensors are preferably in or on this connection housing, i.e. in or on the cradle or the support block and is particularly preferably fastened. From a constructional point of view, it is possible to install the sensors in the cover plates on the cradle or the support block. The connecting housing can be a housing that is open in regions and its openings can be closed by one or more cover plates. The sensors can be connected to these cover plates. However, the sensor(s) can also be connected to permanently installed parts of the connection housing.

Overall, an early detection of wear on bearings, guides and/or joints is achieved in a simple manner by the eccentric screw pump according to the invention. This makes it possible to better plan maintenance work or maintenance measures or repairs. Unplanned stoppages can be reduced or avoided, so that the service time increases. The detection according to the invention is characterized by a very low susceptibility to interference. It is, in particular, less susceptible to disturbance variables in the surroundings of the pump than for example vibration measurements. While for example vibration measurements also react to disturbances that can be caused by the stator wear, the measurement of the concentricity deviation according to the invention adjacent a centrally rotating part makes possible a targeted and uninfluenced detection of concentricity deviations.

The invention relates not only to the eccentric screw pump itself, but also to a method of operating such an eccentric screw pump. According to the invention, a movement profile of the connecting shaft is determined by measuring the distance of the (circular or cylindrical outer surface) of the connecting shaft from the sensor. According to the invention, there is consequently a monitoring of possible concentricity deviations with the sensor according to the invention during the operation of the eccentric screw pump. In the manner already described, a plurality of sensors can preferably be arranged in different angular positions, i.e. at least two sensors are distributed over the circumference of the connecting shaft.

It is within the scope of the invention that the determined or measured values, i.e. the values measured with the detectors or sensors (e.g. distance values representing a single-revolution deviation) are compared with previously stored reference values, and that a message (error message) is generated and/or displayed and/or transmitted when a predetermined deviation limit is exceeded. In the simplest case, there is consequently no feedback of any possible tolerance overage to the pump or the pump control, but a simple condition monitoring takes place that indicates an intolerable single-revolution deviation, for example optically and/or acoustically. In one possible development, however, a combination with a pump control can also take place, so that the pump depends on the measured values or is operated and/or is switched off by comparing the measured values with stored reference values. In preferred embodiments, however, the monitoring serves for early detection of damage, e.g. joint damage or bearing damage, in order to be able to better plan later maintenance work, so that immediate feedback to the pump control is not required.

In addition, wear on joints and bearings or guides, inter alia is the wear in the joints with which the coupling rod is connected, on the one hand, to the rotor and, on the other hand, to the connecting shaft (e.g. plug-in shaft). Such wear can lead to concentricity deviations. The same applies to wear on bearings or guides, and this means for example the guides adjacent the shaft seal (e.g. sliding ring seal). In addition, wear in the area of the bearing in the drive or the transmission thereof can be seen. Wear of the coupling rod that is arranged between the rotor and the connecting shaft, also results in a concentricity deviation of the connecting shaft and is detected in this way.

BRIEF DESCRIPTION OF THE DRAWING

The invention is explained in more detail below on the basis of drawings that are merely exemplary. They show

SPECIFIC DESCRIPTION OF THE INVENTION

Figure 1:
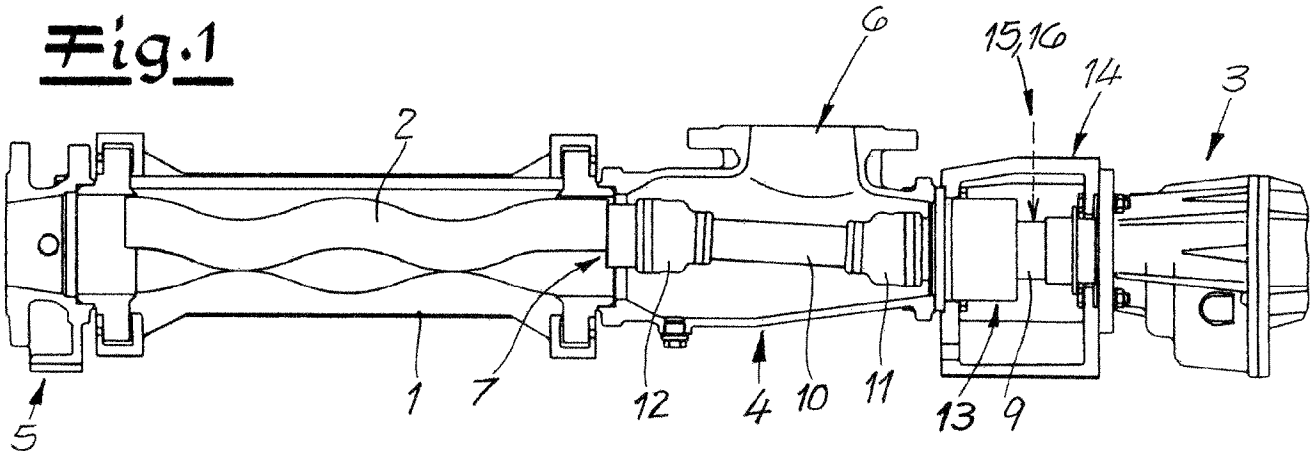
FIG. 1 shows an eccentric screw pump in a simplified side view.

The figures each show an eccentric screw pump that, in its basic design, has a stator 1, a rotor 2 rotating in the stator 1, and a drive 3 for the rotor 2. A pump housing 4, which is also referred to as a suction housing 4, is connected to the stator 1 (e.g. on the suction side). A housing part that is connected to the stator 1 at the opposite end of the stator 1 (e.g. on the pressure side), is referred to as a connecting piece or pressure connection piece 5. The pump housing 4 has an inlet opening 6 (or, depending on the pumping direction, outlet opening), via which, for example, the medium to be conveyed is supplied via the stator/rotor 1, 2 to the pressure connection piece 5. The drive 3 is equipped with an output shaft (not shown) that is connected to a connecting shaft 9. This connecting shaft 9 is a plug-in shaft 9 in this embodiment. In this embodiment, the rotor 2 is connected to the connecting shaft 9 via a rigid coupling rod 10, and the coupling rod 10 is connected to the connecting shaft 9 via a drive-side joint 11 and to the rotor 2 via a rotor-side joint 12, such that eccentric movement of the rotor 2 or rotor end 7 is made possible via the coupling rod 10 and the joints 11, 12. The drive thus operates on the connecting shaft 9 that rotates centrally about an axis R under ideal conditions. The eccentric movement of the rotor end 7 is made possible by the coupling rod 10. In principle, however, it is also possible to work with embodiments without joints, in that for example the coupling rod is of elastic design. Such an embodiment is not shown. The (elastic) coupling rod can also be formed in one piece with the rotor 2 and consequently form one end of the rotor 2. Moreover, embodiments in which the coupling rod is provided with one or more conveying devices, for example with a worm that can be a hollow screw or a solid screw, are also basically detected. Such coupling rods that carry a worm, are used for example in the case of eccentric screw pumps when serving as funnel pumps. Such an embodiment is also not shown in the drawing. However, the explanations in the description of the figures relate equally to the mentioned embodiments (not shown).

A connecting housing 14 is provided between the pump housing 4 and the drive 3. In the embodiment according to FIGS. 1 and 2, this connecting housing 14 is a so-called cradle. The connecting shaft 9 is at least partially inside this connection housing 14. For the liquid-tight separation of the pump housing 4 from the environment or relative to the drive 3, the connecting shaft 9 is sealed with a shaft seal 13 that can be for example a sliding ring seal.

According to the invention, at least one sensor 15, 16 is spaced from the connecting shaft 9 for detecting or measuring concentricity deviation, this sensor determining a movement profile of the connecting shaft 9 in a predetermined angular position of the connecting shaft 9 by measuring the distance of the surface of the (cylindrical) connecting shaft 9 from the sensor 15, 16. In this illustrated embodiment, two sensors 15, 16 are provided that are angularly offset relative to one another. In this embodiment, the angular offset is approximately 90°. The sensors 15, 16 are designed for example as contactless inductive proximity sensors. Under ideal conditions, the connecting shaft 9, driven by the drive 3, rotates concentrically to the rotation axis R since it has a circular cross-section, so the distance of the surface from the fixedly positioned sensor 15, 16 does not change during rotation, and measurement of the distance as a function of time and consequently from the angular position of the shaft 9 leads to a constant signal. In practice, however, a concentricity deviation occurs, specifically as a function of the state of wear of various parts of the pump. A concentricity deviation results in the sensor 15, 16 measuring a different distance during operation for different angular positions of the connecting shaft 9. With the aid of the sensor 15 or 16 or with the aid of the sensors 15, 16, concentricity deviation can consequently be determined very easily and reliably and from this concentricity deviation it is possible to infer a wear state. For this purpose, it is possible for example to compare the determined values with stored reference values, such that an error message is generated and/or displayed and/or transmitted when a predetermined deviation is exceeded. An optical display (not shown) can for example be provided on the pump. Alternatively or additionally, acoustic signals can also be generated. It is also possible to transmit the signal to a pump controller so it can be displayed at the controller. The sensors and/or the evaluation of the signals can also be fed to a pump control (e.g. to a PLC controller).

Figure 2:
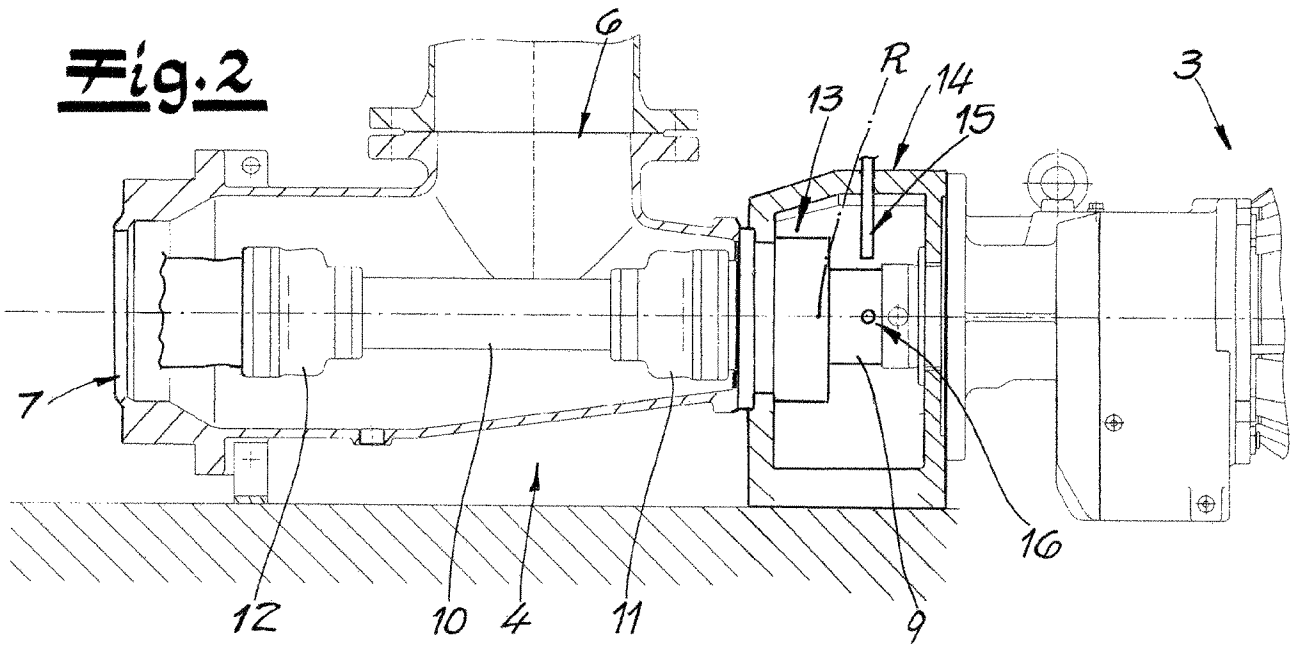
FIG. 2 shows an enlarged detail of the subject matter according to FIG. 1.
Figure 3:
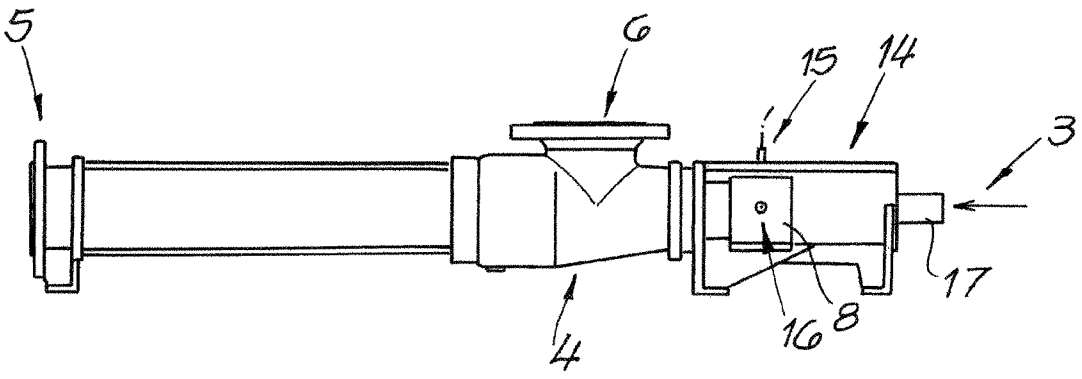
FIG. 3 shows a modified embodiment of an eccentric screw pump in a simplified side view.
Figure 4:
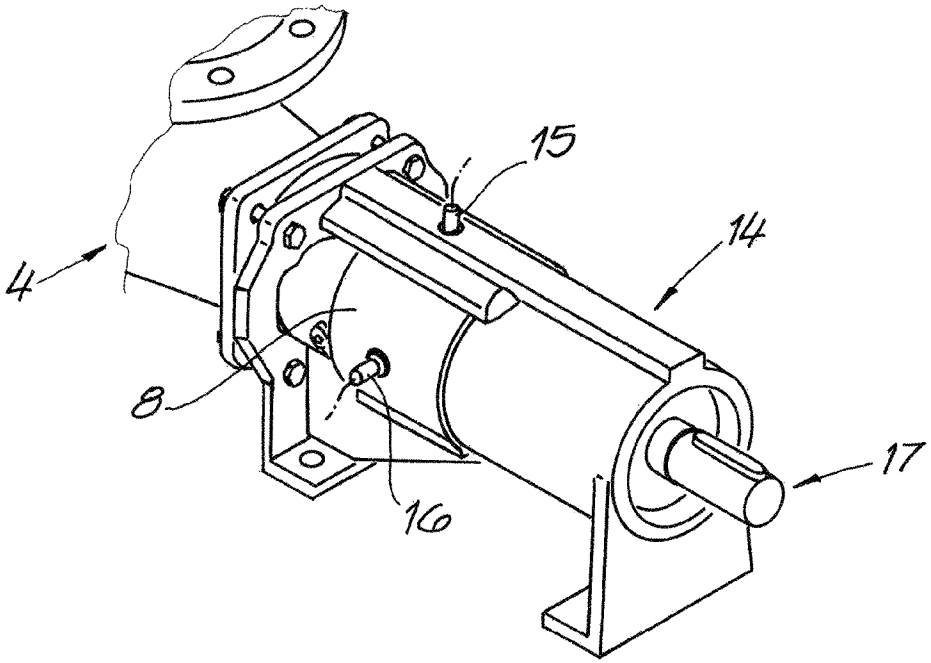
FIG. 4 shows a detail from the subject matter according to FIG. 3 in perspective.

While FIG. 1 shows an embodiment of an eccentric screw pump in which the connecting housing 14 is a so-called cradle, FIG. 2 shows a modified embodiment of an eccentric screw pump in which the connecting housing 14 is a support block. In particular in FIG. 4 the two sensors 15, 16 offset by 90° can be seen adjacent the bearing block 14 that determine or monitor the concentricity deviation of the connecting shaft 9 (not shown). Detachable covers, e.g. cover plates 8, on which for example a sensor 16 can be fastened, can be seen on the housing 14. The sensor 15 is fixed to a stationary part of the housing 14. The drive 3 is not explicitly illustrated in the embodiment according to FIGS. 3 and 4. It can be connected to the drive shaft 17.

The invention claimed is:

1. An eccentric screw pump comprising:

a stator, a rotor rotating in the stator, a drive, a pump housing connected to the stator and having at least one inlet or outlet opening for a medium to be conveyed, a connecting shaft driven by the drive and rotating concentrically with an axis on ideal operation of the pump, a connecting housing connected between the pump housing and the drive and at least partially surrounding the connecting shaft, a coupling-side shaft seal between the connecting shaft and the connecting housing, a coupling rod in the pump housing and connected to the connecting shaft at a drive-side end and to the rotor at a rotor-side end thereof and generating eccentric movement of the rotor-side end on concentric rotation of the connecting shaft, and means including a sensor mounted in or on the connecting housing adjacent the connecting shaft for detecting or measuring deviation from axially concentric rotation thereof for determining a movement profile at a predetermined angular position of the connecting shaft by measuring a distance between an outer surface of the connecting shaft and the sensor.

2. The eccentric screw pump according to claim 1, wherein at least two of the sensors adjacent the connecting shaft measure concentricity deviation thereof, are in different angular positions offset relative to one another by an angular offset, and each determine the movement profile of the connecting shaft by detecting a distance of the outer surface of the connecting shaft from the respective sensor at different angular positions.

3. The eccentric screw pump according to claim 2, wherein the angular offset is at least 10°.

4. The eccentric screw pump according to claim 1, wherein the sensor is contactless and detects proximity optically or inductively.

5. The eccentric screw pump according to claim 1, wherein the sensor is provided axially of the pump between the drive-side end of the connecting shaft and the coupling-side shaft seal seals the pump housing in a liquid-tight manner with respect to the surroundings or with respect to the connection housing connected to the pump housing.

6. The eccentric screw pump according to claim 1, wherein the connecting housing is a lantern or a support block.

7. A method of operating an eccentric screw pump comprising:

a stator, a rotor rotating in the stator, a drive, a pump housing connected to the stator and having at least one inlet or outlet opening for a medium to be conveyed, a connecting shaft driven by the drive and rotating concentrically with an axis on ideal operation of the pump, a connecting housing connected between the pump housing and the drive and at least partially surrounding the connecting shaft, a coupling-side shaft seal between the connecting shaft and the connecting housing, a coupling rod in the pump housing and connected to the connecting shaft at a drive-side end and to the rotor at a rotor-side end thereof and generating eccentric movement of the rotor-side end on concentric rotation of the connecting shaft, and means including a sensor mounted in or on the connecting housing adjacent the connecting shaft for detecting or measuring deviation from axially concentric rotation thereof for determining a movement profile at a predetermined angular position of the connecting shaft by measuring a distance between an outer surface of the connecting shaft and the sensor, the method comprising the step of the sensor determining the movement profile of the connecting shaft in at least one predetermined angular position of the connecting shaft by measuring a distance of the outer surface of the connecting shaft from the sensor.

8. The method according to claim 7, wherein with two sensors provided in different angular positions, each determines a movement profile of the connecting shaft for a respective different angular position by measuring the respective distance between the outer surface of the connecting shaft and the respective sensor.

9. The method according to claim 7, wherein the movement profile is determined or measured continuously.

10. The method according to claim 7, wherein the movement profile or the distance values measured with the sensor or with the sensors are compared with stored reference profiles or reference values, and an error message is generated and/or displayed and/or transmitted when a predetermined deviation is exceeded.

11. An eccentric screw pump comprising:

a stator;

a rotor rotating in the stator;

a drive;

a pump housing connected to the stator and having at least one inlet or outlet opening for a medium to be conveyed;

a connecting shaft driven by the drive and rotating concentrically with an axis on ideal operation of the pump;

a connecting housing connected between the pump housing and the drive and at least partially surrounding the connecting shaft, a coupling-side shaft seal between the connecting shaft and the connecting housing, a coupling rod in the pump housing and having a drive end connected to the connecting shaft and an axially opposite rotor end connected to the rotor, the coupling rod generating eccentric movement of the rotor end on axially concentric rotation of the connecting shaft; and a sensor axially and radially fixed in or on the connecting housing adjacent the connecting shaft for detecting or measuring radial deviation from axially concentric rotation thereof for determining a movement profile at a predetermined angular position relative to the axis of the connecting shaft by measuring a distance between an outer surface of the connecting shaft and the sensor.

* * * * *